US009420904B1

(12) United States Patent
Russell

(10) Patent No.: US 9,420,904 B1
(45) Date of Patent: Aug. 23, 2016

(54) BED COVER AND METHOD

(71) Applicant: Ruby Russell, Sparks, NV (US)

(72) Inventor: Ruby Russell, Sparks, NV (US)

( * ) Notice: Subject to any disclaimer, the term of this patent is extended or adjusted under 35 U.S.C. 154(b) by 0 days.

(21) Appl. No.: 14/659,569

(22) Filed: Mar. 16, 2015

(51) Int. Cl.
*A47G 9/02* (2006.01)

(52) U.S. Cl.
CPC ..... *A47G 9/0238* (2013.01)

(58) Field of Classification Search
CPC ..... A47G 9/00; A47G 9/02; A47G 9/0238; A47G 9/0246; A47G 9/04; A47C 27/002; A47C 31/105
USPC ..... 5/485, 488, 495, 497, 498
See application file for complete search history.

(56) References Cited

U.S. PATENT DOCUMENTS 3,654,646 A * 4/1972 McMahon, Jr. ..... A47G 9/0246 5/482
4,391,010 A * 7/1983 Kronman ..... A47G 9/0238 5/484
4,646,375 A * 3/1987 Parker ..... A47C 21/022 5/485
6,952,845 B1 * 10/2005 Akkad ..... A45F 4/02 383/4
8,495,773 B2 * 7/2013 Liversage ..... A47G 9/0246 5/496
2005/0071924 A1 * 4/2005 Ratigan ..... A47G 9/0238 5/497

* cited by examiner

*Primary Examiner* — Nicholas Polito
(74) *Attorney, Agent, or Firm* — John D. Long, Esq.; Long & Chybik

(57) ABSTRACT

The invention could be a bed cover comprising a base sheet that includes a top base edge, a bottom base edge, a first side base edge and a second side base edge, the top base edge being located opposite of the first base end, wherein the top base edge and bottom base edge are connected together by the first side base edge and the second side base edge; a tab sheet that has a pocket tab portion and a top tab portion, the top tab portion attaches to the base sheet via the bottom base edge while the pocket tab portion further forms an open-ended pocket having an aperture, the open-ended pocket being sufficiently constructed to accommodate at least a portion of a first hand of an operator passing through the aperture.

18 Claims, 11 Drawing Sheets

BED COVER AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to bed cloths or bed covers used to cover a mattress. More specifically, the present invention may relate to those bed cloths or bed covers which further have a tab at one end that may be inserted underneath a mattress to which the bed cover or bed cloth may be applied.

BACKGROUND

The modern bed may be seen as having at least a mattress (e.g., as supported by some form a mattress support, one or more portions of the mattress being covered by one or more bed covers. The mattress could be seen as having a casing made from suitable fabric containing deformable or resilient material for sleeping. In one possible circumstance, the mattress support could be a bed frame that lifts the mattress up and away from the ground. In some other instances, the bed support could be a box spring, a fabric covered frame housing a set of vertical springs, as supported by the bed frame. The box spring in this case generally being inserted between the mattress and the bed frame.

The bed covers or bed cloths may include fitted rectangular sheets such as a mattress cover or pad, bed linens or sheets (e.g., fitted bottom sheet and non-fitted top sheets) placed over the top of the mattress cover. One or more blankets or quilts could be suitably placed over the bed sheets with a bed spread that may be placed over the blankets or quilts.

In applying such bed covers or bed cloths, a fitted mattress cover/pad may be applied first to the mattress. Another fitted bed sheet may then be applied over the fitted mattress cover. A non-fitted bed sheet may then be laid over the fitted bed sheet with a portion of the non-fitted bed sheet being tucked in (e.g., the operator could grasp the appropriate sheet edge and insert the sheet edge) under one end of the mattress (e.g., a foot end). In this manner, the sheet edge could be inserted in between a bottom of the mattress and a top of the mattress support. A blanket may then be laid over the non-fitted sheet and suitable be tucked under the mattress in a manner similar to the non-fitted sheets. Comforters, quilts, bed spreads or the like may then be suitably placed over the blanket but generally these additional bed covers are not tucked in.

The generally accepted epitome of bed making methods could be the method used in the military as well as many hotels, hospitals, using a technique known as the "hospital corner" bed making method. In the bed making method, the bed cloths or bed covers (e.g., mattress covers, sheets, blankets, etc. that are normally applied to mattress in a tucked-in manner) could be tucked in at the mattress' foot ends and sides with such resulting tension that one can literally bounce a coin (e.g., a quarter) off the top of the bed. The hospital corner bed making method basically imparts a gift wrapping fold to the bed cover at the each of foot corners of the mattress so that bed covers or bed cloths are tucked underneath both the bed's foot ends and sides. In this manner, the bed covers or bed cloths could be pulled taut over the top of the mattress with the head end of bed being the only untucked portion of the bed. When the bed is then used, the hospital corner bed making method generally provides a good means of anchoring the bed covers or bed cloths to the mattress as a person sleeps in the bed.

As the baby boomer population continues to move from middle age to old age, there may be increased need to address issues that generally accompany this large aging population. One such issue may be that a person's physically capacity during the aging process may decrease as that physically capacity relates to physical household tasks such a bed making or may be otherwise marked by a lacked of interest in making the bed (e.g., using of the hospital corner method.) As arthritis or the loss of muscular strength occurs during aging, it may become harder for the person to grasp an edge of a bed cover or bed cloth and then thrust the grasped edge in underneath a mattress (e.g. between the mattress and mattress support.) Further, the feet of the person using the bed could be uncomfortably held down by tautness of hospital corners and make it hard for such a person to swing their feet out of bed.

Another issue may be medical in nature for as the person ages, that person may become more susceptible to physical disabilities, such as foot afflictions, which may arising from diabetes, gout or other infirmities. These foot afflictions may come in the form of extreme pressure/pain sensitivity. For example, gout in particular may diagnosed during a flare-up by having a pressure sensitivity caused by inflammation of the thalamus or big toe joint. Even the light presence of a single bed sheet upon that foot area may induce a very, very painful response for gout sufferers. Such tactile sensitivity as found in gout may also occur with diabetes patients. In such circumstances, sleeping in a bed made by hospital corners method with a resulting bed cover tautness may make it very difficult if not painful for such people to sleep in such bed.

What is needed therefore could be the present invention, generally comprising a bed cover or bed cloth and a means of using same that makes bed making easier and faster for an ageing population; provides a suitable means to anchor the bed covers or bed cloths in a self-centering manner and further relieves the movement restriction as imposed by the hospital corner tautness. Such a bed cloth or cover could be a base sheet combined with a smaller tab sheet to generally form a T-shape. The base sheet could be substantially rectangular in nature, having two sides connecting a top (head) edge with a bottom (foot) edge. A tab sheet could further extend from the bottom edge, the tab sheet not being as wide or as long as the top sheet. The tab sheet could further define an open-ended pocket that has an aperture that opens out onto the remaining tab sheet and could further allow passage of at least a portion of an operator's hand into the open-ended pocket. In this manner, after the invention has been laid over the mattress (or over other bed covers previously applied to the mattress), the operator could place at least a portion of one hand into the open-ended pocket to guide at least the open-ended pocket and hand combination towards and underneath the mattress (e.g., be inserted between a mattress and a mattress support) without having to grasp the bed cover/bed cloth to do so. Other bed cloths or covers used in making the bed could be suitable constructed and applied in a similar manner to the mattress to further complete the making of the bed.

The corners of the bottom edge generally are not inserted underneath the mattress and allow the base sheet to lay loose upon the mattress top and sides to substantially eliminate the application of hospital corners for the foot corners of applied bed cover. In substantially letting the foot end corners of the bed cloths/bed covers lay down in a loose manner, a foot end of the bed could be relieved of a downward pressure (as otherwise provided by the tautness of hospital corners) that could be painful to those persons having medical foot conditions. The invention could further make it easier for older persons to swing their feet out of the bed, while still having a means that held keep the bed cloths/bed covers in place upon the made bed.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to generally allow faster and easier making of a bed especially by persons with impaired physical capabilities;

provide a bed cover that has an open-ended pocket that allows an operator's hand(s) to insert a portion of the bed cover between a mattress and mattress support without having to grasp the bed cover;

the ability to attach bed covers/bed cloths to a mattress that provide for simple self-centering of the said cloths/covers upon the mattress;

provide a means for anchoring bed covers/cloths to mattress that allow the foot end corners of the cover/cloth to be free and not be taut;

the ability to swing one's feet out from foot end corners of a bed; and provide an anchor means for bed covers or bed cloths to the mattress that keeps the bed covers or bed cloths stay in place upon the mattress throughout a bed user's sleep cycle day after day.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a bed cover comprising a base sheet that includes top edge and a bottom edge, a first side edge and second side edge that is opposite of the first side edge, wherein the first side edge and second side edge are between the top edge and bottom edge; a tab sheet that has a pocket portion and base portion, the base portion attaches to the base sheet via the bottom edge while the pocket portion forms an open-end pocket having an aperture that opens out upon the base portion, the open-ended pocket being sufficiently constructed to accommodate at least a portion of an operator's hand.

Another possible embodiment of the invention could be a bed cover comprising: a base sheet and a tab sheet that together form an inverted T-shape, wherein the tab sheet is connected to the base sheet, the tab sheet further forming an open-ended pocket having a aperture that can allow passage of at least a portion of a hand of the operator; wherein the aperture opens out onto the tab sheet in a manner that allows the operator to move at least a portion of the hand into the open-ended pocket to insert the open-ended pocket underneath a mattress to which the bed cover is being applied.

Yet another possible embodiment of the invention could be a method of applying a bed cover to a mattress comprising the following steps, but not necessarily in the order shown: providing a bed cover comprising a base sheet and a tab sheet that together forms an inverted T-shape, the tab sheet further forms a pocket portion that forms an open-end pocket having an aperture that allows passage into the open-ended pocket of at least a portion of an operator's hand; providing a mattress having a top mattress portion connected by mattress sides to a bottom mattress portion; inserting at least a portion of an operator's hand into the open-ended pocket; and directing the open-ended pocket towards the bottom mattress portion to locate at least a portion of the open-ended pocket under the bottom mattress portion.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, various specific embodiments in which the invention may be practiced. It is to be understood that other embodiments may be utilized and structural changes may be made without departing from the scope of the present invention.

The present invention 10 could comprise a bed cover or a bed cloth 10 and a method of use for same 200. As shown generally in FIGS. 1 and 2, the bed cloth or bed cover 10 may be used as a bottom sheet, top sheet, blanket, quilt or other generally non-fitted bed cover device. The invention 10 may be applied to other such devices such as pillows, pads as used in furniture (e.g., chair, sofa, couch pads) or other similar types of devices (not shown). The present invention 10 could be applied to wide variety of sheets including but not limited to sheets comprising of flexible materials.

Figure 1:
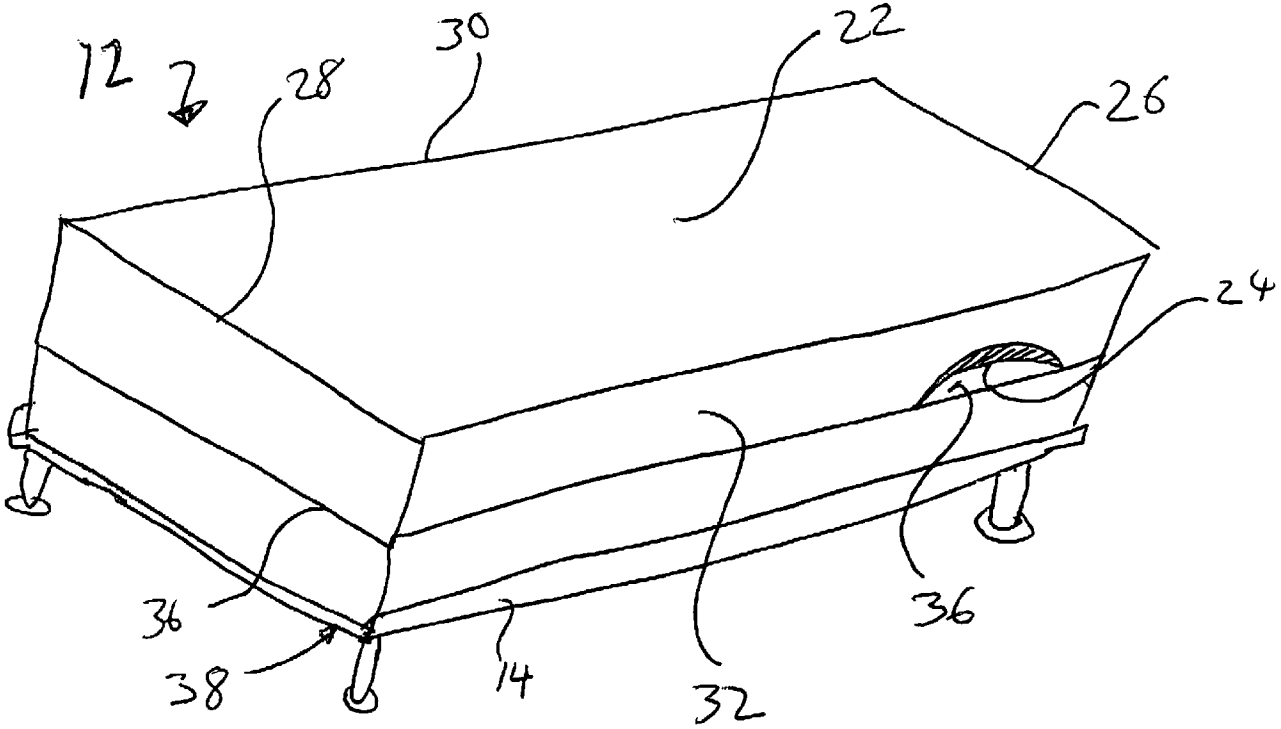
FIG. 1 is substantially a perspective cutaway top view of one version of a bed that could be used with the present invention.

As substantially shown in FIG. 1, one possible version of a bed 12 that the invention 10 could be applied to could comprise a mattress 20. In one embodiment, the mattress 20 could be subsequently supported by a mattress support such as a bed frame 14. In one version of such an embodiment, the mattress could substantially supported by a box spring 34 placed in between the mattress support and the mattress 20.

In one such embodiment, the mattress 20 could be a casing made from suitable fabric containing deformable or resilient material (not shown) for sleeping. The mattress 20 could have a top mattress portion 22 connected to a bottom mattress portion 24 by a head end 26, a foot end 28, a first mattress side 30 and a second mattress side 32. The head end 26 and foot end 28 could oppose each other in a parallel orientation, the head end 26 and foot end 28 further being connected to one another by the first mattress side 30 and the second mattress side 32. The portions of the mattress 20 denoted by where the foot end 28 connects to the first mattress side 30 and second mattress side 32 could be considered the foot end corners 34.

The box spring 34 could be a fabric covered frame housing a set of vertical springs (not shown.) The box spring 34 could be similarly shaped as the mattress 20 and could support the mattress 20 upon the box spring's top 36. The box spring's bottom 38 could be supported by a bed frame 14, which in one possible embodiment could be a set of connected support railings lifted off the floor by support legs.

Figure 2:
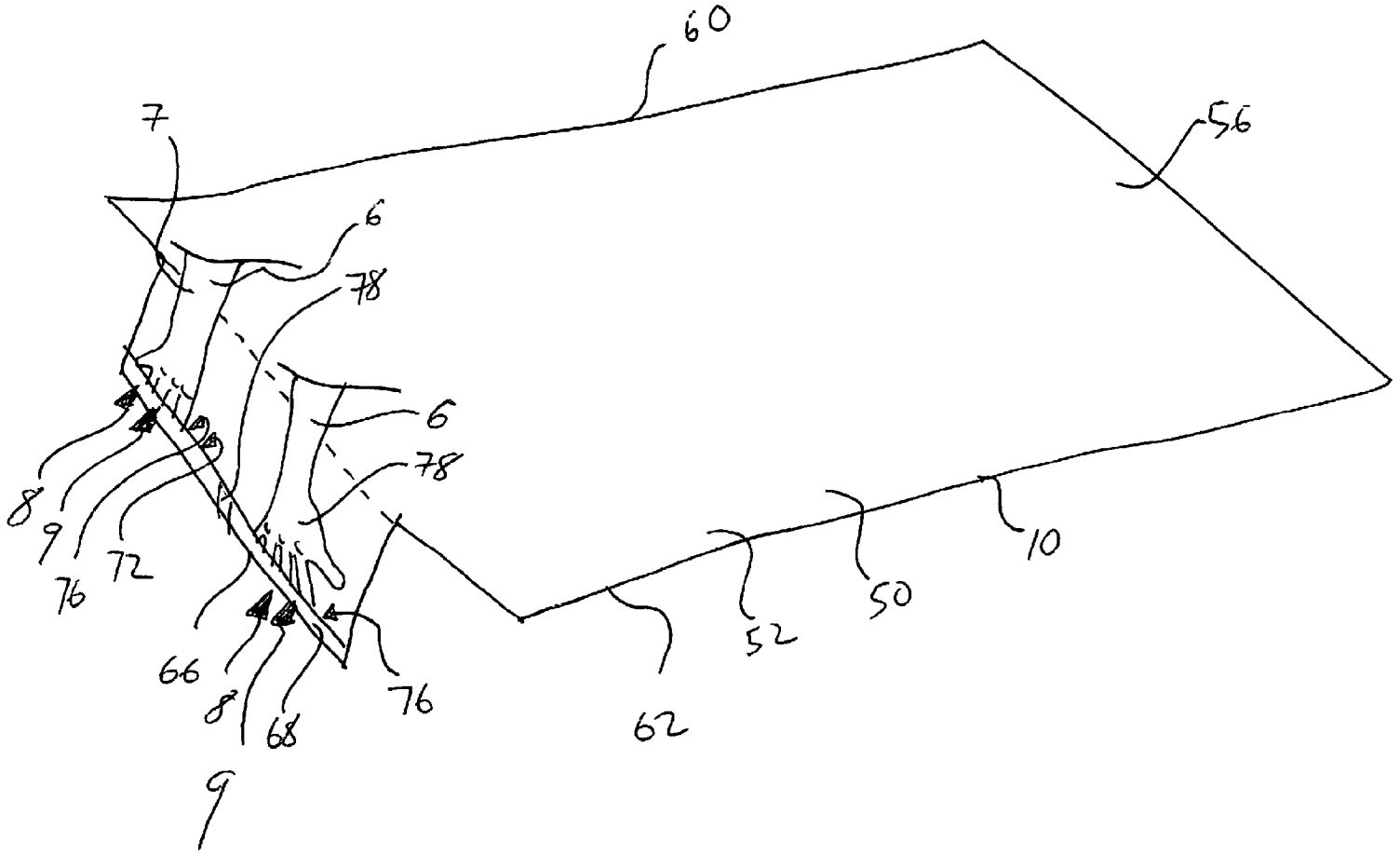
FIG. 2 is substantially a perspective cutaway top view of one embodiment of bed cover of the present invention.
Figure 2A:
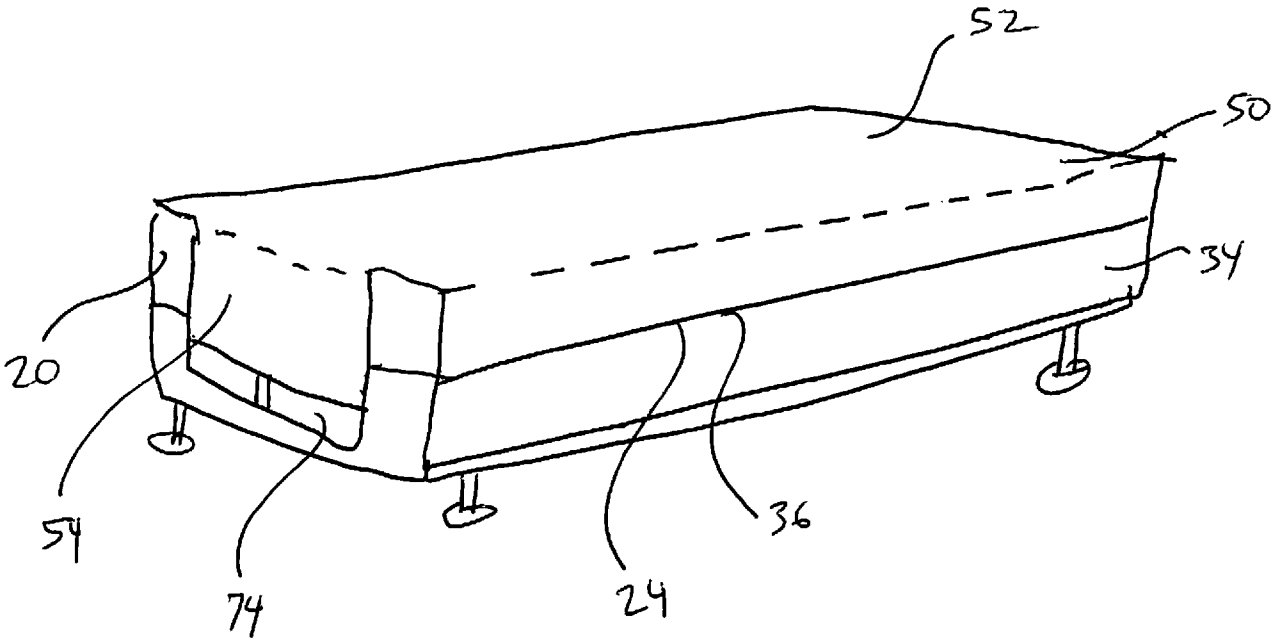
FIG. 2A is substantially a perspective cutaway top view of one embodiment of bed cover of the present invention lying upon a mattress.
Figure 3:
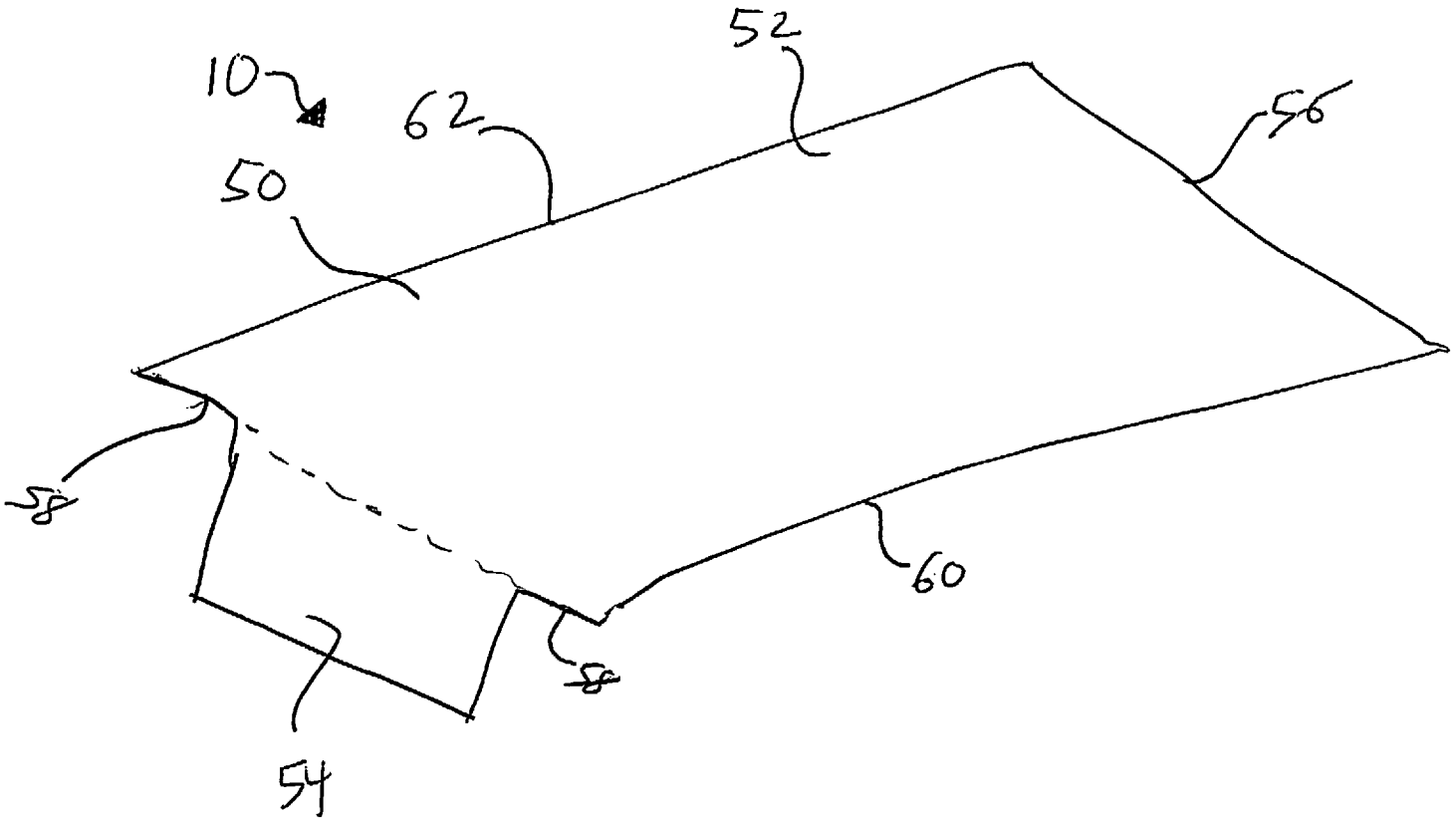
FIG. 3 is substantially a perspective bottom view of one embodiment of the bed cover of the present invention.
Figure 4:
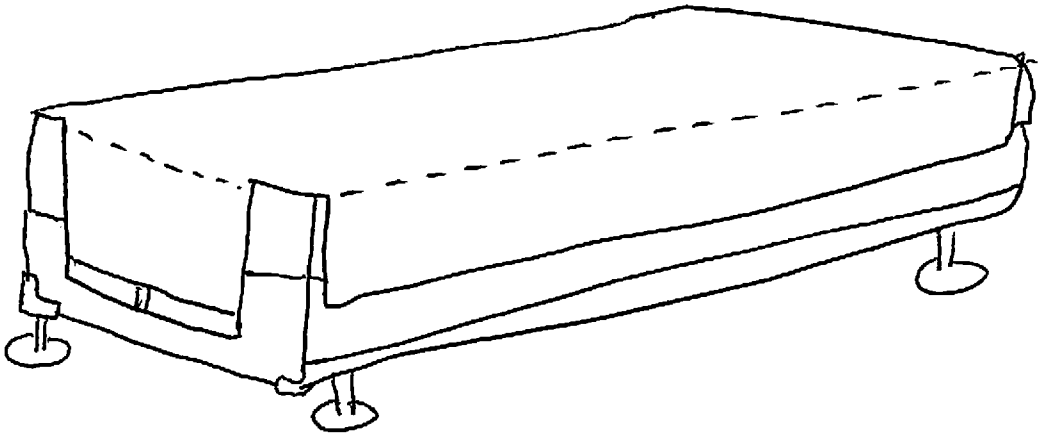
FIG. 4 is substantially a perspective view of one embodiment of the bed cover of the present invention being applied to the bed.
Figure 5:
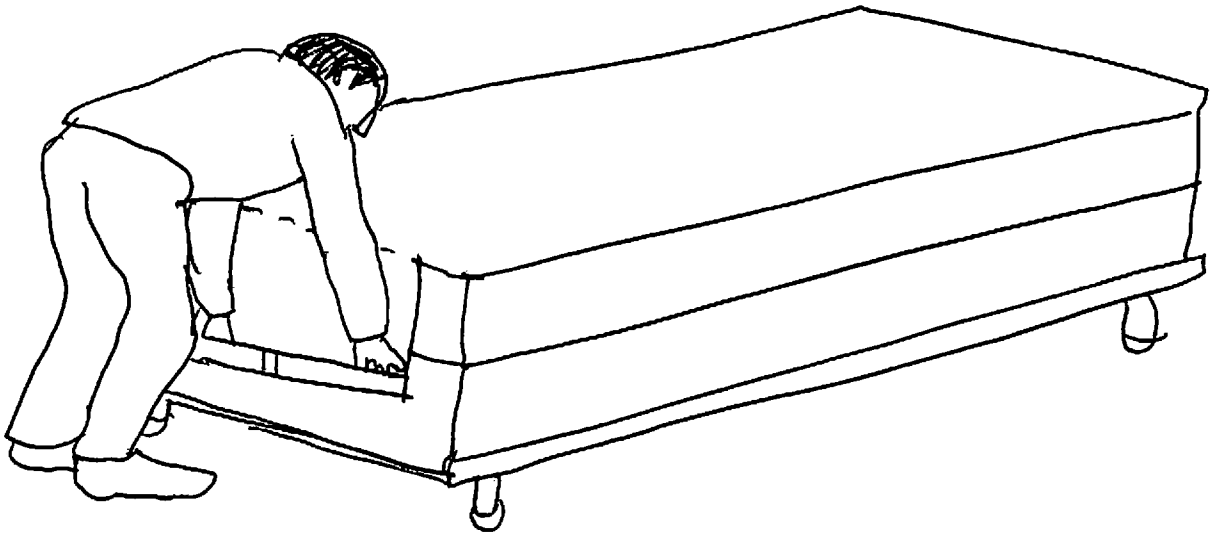
FIG. 5 is substantially another perspective view of one embodiment of the bed cover of the present invention being applied to the bed.
Figure 6:
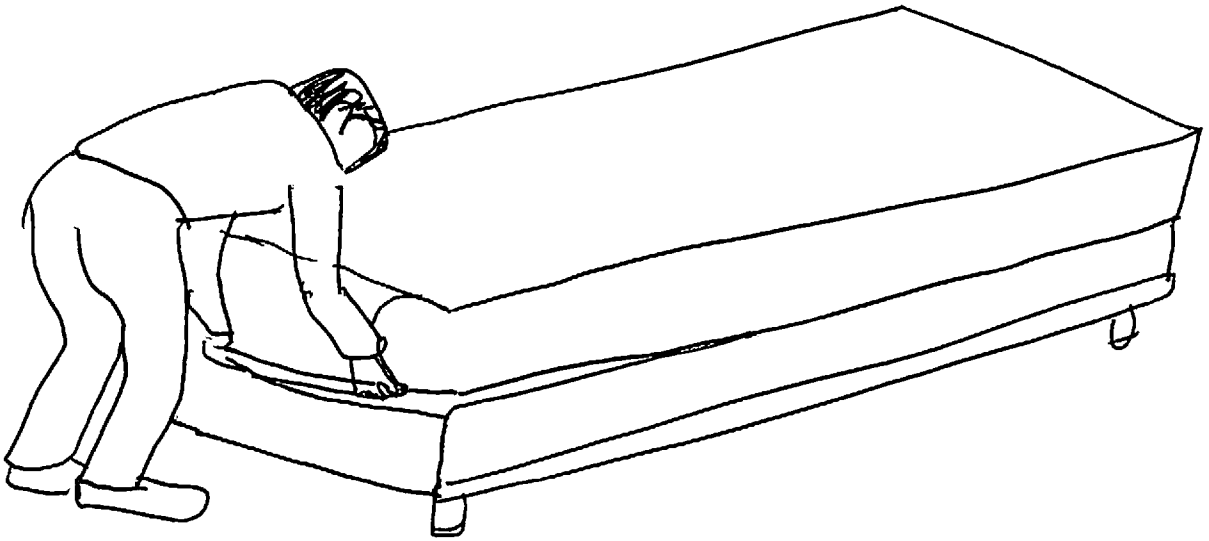
FIG. 6 is substantially a yet another perspective view of one embodiment of the bed cover of the present invention being applied to the bed.
Figure 7:
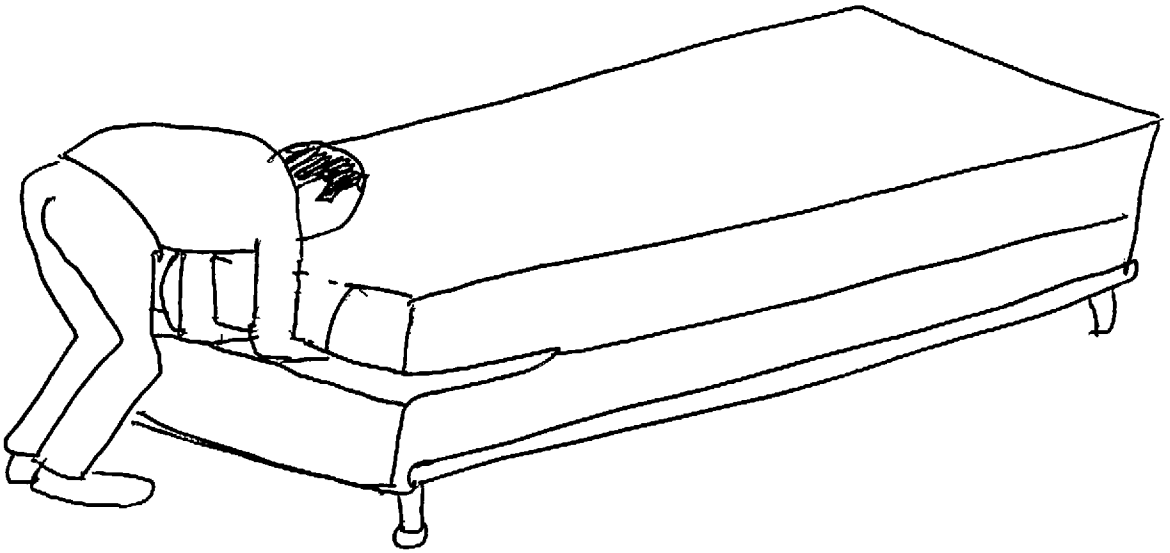
FIG. 7 is substantially a still yet another perspective view of one embodiment of the bed cover of the present invention being applied to the bed.
Figure 8:
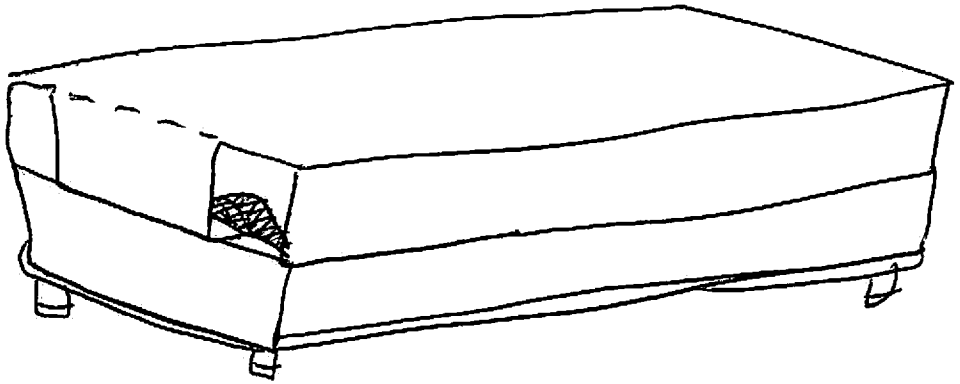
FIG. 8 is substantially a perspective cutaway view of one embodiment of the bed cover of the present invention being applied to the bed.
Figure 9:
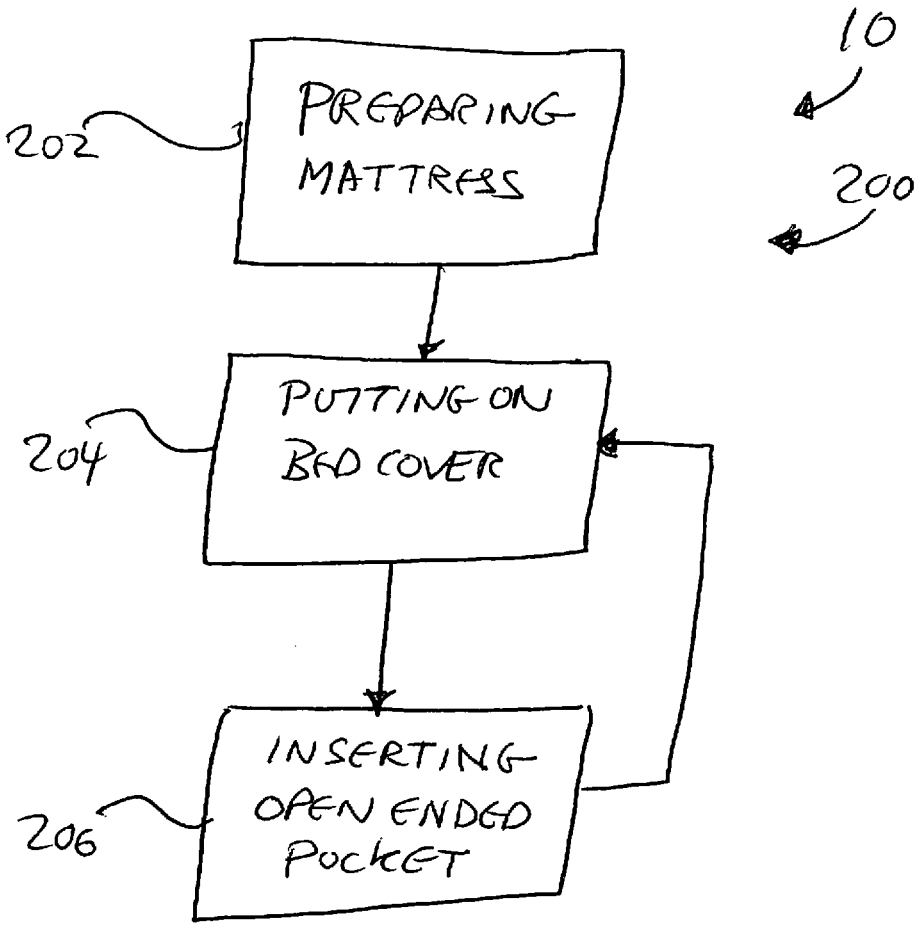
FIG. 9 is substantially a flowchart schematic showing one possible embodiment of a process or method for operating the present invention.

As substantially shown in FIGS. 2, 3, and 4, the bed cover or bed cloth 50 could comprise a base sheet 52 and a tab sheet 54 that generally connect together to form a T-shape. The base sheet 52 could be rectangular in shape and may be applied to the top mattress portion 22. The bed cover 20 could further incorporate a finished ½ inch fold over hem to act as a reinforcement seam (not shown.) The tab sheet edges could further comprise a base tape reinforcement to accommodate stretch and strain in this area (not shown.) The base sheet 52 may be defined by defined by a top base edge 56, a bottom base edge 58, a first side base edge 60 and second side base edge 62 wherein the top base edge 56 and bottom base edge 58 may oppose one another in a parallel fashion and could be further connected to one another by the first side edge 60 and second side edge 62.

The tab sheet 54 could also be rectangular in shape but generally smaller in size to the base sheet 52 (the tab sheet 54 could have a width and length that is respectively less that of the width and length of the base sheet 52) so that tab sheet 54 generally does not contact the base sheet's first base edge 60 and second base edge 62. The tab sheet 54 could comprise a pocket tab portion 64 and a top tab portion 66, the top tab portion 66 generally connecting the tab sheet 52 (e.g., top tab portion) to the bottom base edge 58. The pocket tab portion 64 could form an open-end pocket 68 having an aperture 70 substantially used to access the open-ended pocket's interior 72. The aperture 70 further generally opening out upon top tab portion 66 and generally towards the bottom base edge 58. The open-ended pocket 68 in at least one embodiment being sufficiently constructed to generally accommodate at least a portion of a hand 7 of an operator 6. In another embodiment, the open-ended pocket 68 could accommodate both of the operator's hands 7 (either partially accommodate in one version or fully accommodate in another version) in the fully extended or open-handed position 8 with fingers 9 either spread apart from one another or with the fingers 9 closed together with one another.

Figure 3B:
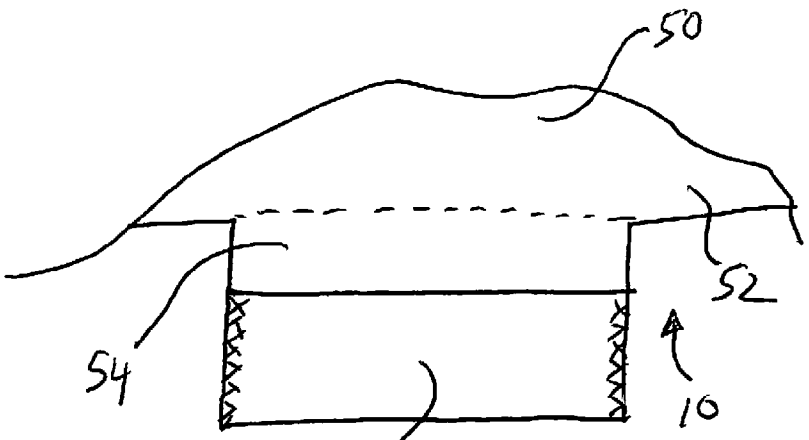
FIG. 3B is substantially a perspective view of another embodiment of the open-ended pocket of the present invention.
Figure 3A:
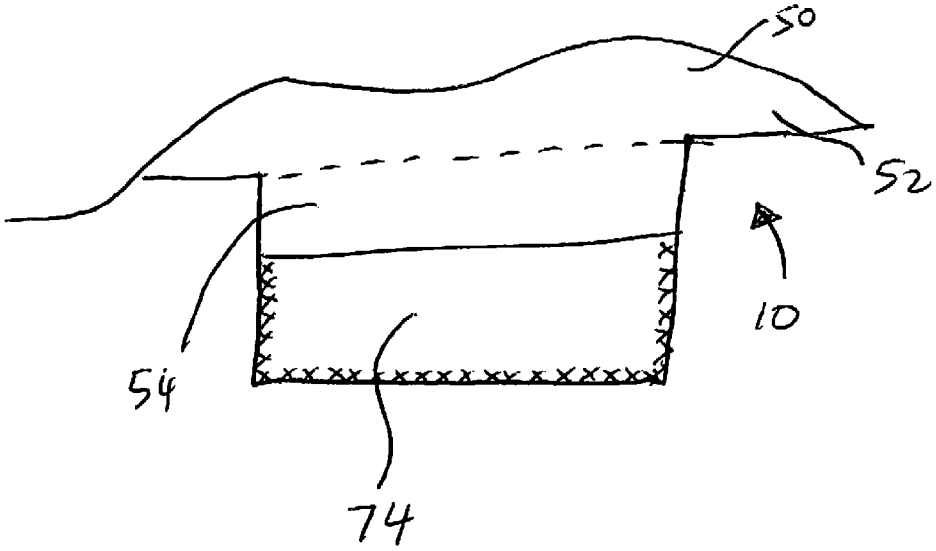
FIG. 3A is substantially a perspective view of one embodiment of the open-ended pocket of the present invention.

As substantially shown in FIGS. 3 and 3A, the open-ended pocket 68 could be formed by overlaying a pocket sheet 74 to the tab sheet 54 to form the pocket tab portion 64 so that the edges of the pocket sheet 74 that contacts and connects to the sides and bottom of the tab sheet 54 to generally form the aperture 70 that substantially opens out upon the top tab portion 66. In another embodiment, as substantially shown in FIGS. 3 and 3B, the open-ended pocket 68 could be formed by folding back a part of the tab sheet 54 upon itself and subsequently generally sealing the three sides of the folded upon part to substantially denote the aperture 72 of open-ended pocket 68. In yet another embodiment, the pocket tab portion 64 could be attached (e.g., sewed) down the middle with a midline seam 78 to bifurcate the open-ended pocket 68 and aperture 70 forming two open-ended sections 76 with each section 76 being able to substantially receive at least a portion of a respective hand 7 of the operator 6 (as substantially shown in FIG. 2.)

Method

As substantially shown in FIGS. 4-9, one possible method, process or procedure 200 for operating the invention 10 could start with step 202 preparing the mattress. In this step, the sheet size of the invention could be determined based on the standard sizes (e.g., king, queen, standard, double, single, etc.) of the selected mattress. Although the bed sheet version is described in this method, other versions of the invention (e.g., blanket, quilt and other bed cover devices) could be applied subsequently and in generally the same manner. Once the size selection of the invention is determined, fitted sheets (box spring cover, mattress cover, and fitted mattress sheet could be suitably applied to the box spring and mattress.) Once the mattress is prepped, the method 200 could proceed to step 204 putting on bed cover onto mattress.

In step 204 putting a bed cover onto mattress, the operator could place the bed cover upon the mattress so that the top portion is located upon the top mattress portion as the tab sheet is generally left hanging down off of the mattress' foot end. The open-ended pocket could be facing away from the foot end so as to expose the aperture to allow the operator access to the open-ended pocket. Then depending on the particular embodiment of the invention, the operator could put at least a portion of the operator's hand through the aperture and into the open-ended pocket. The hand could be fully extended (e.g., open-handed) with the palm generally facing the mattress. In the bifurcated version of the open-ended pocket, the operator could place both hands into the open-ended pocket with each hand being substantially being placed in a respective section. In that version, each hand could be located within a respective section so as to be touching the tab sheet edge (e.g., the open-ended pocket edge that is opposite the aperture) of the section (e.g., hands could be spread apart to be located by the sides of the pocket portion.) The fingers of the respective hand could be spread apart from one another or the fingers of the respective hand could be could be placed alongside one another as the hand's finger tips generally engage bottom seam of the open-ended pocket As this step is substantially completed, the method 200 could proceed to the step 206, inserting the open-ended pocket underneath the bottom mattress portion.

In the step 206, inserting the open-ended pocket underneath the bottom mattress portion, the operator could direct its hand(s) and hence the engaged open-ended pocket towards the bottom mattress portion. Once the pocket portion is so inserted, the operator could move its hand(s) within the pocket portion so that the pocket portion substantially lays flat underneath the mattress for a maximum adhesion to the mattress bottom (e.g., or for being held between the mattress and the mattress support.) The pocket portion could be so placed under the bottom mattress portion (e.g., inserted in between the box spring and the mattress) so that the pocket tab portion is generally placed against a middle of the foot edge and/or underneath the mattress to centralize the bed cover upon the mattress. Once the open-ended pocket is correctly placed, the operator can remove her hand(s) from the open-ended pocket, leaving the open-ended pocket generally sandwiched against the mattress to substantially anchor the bed cover to the mattress.

As anchored, the bed cover at the foot corners could be loose and non-constrictive at that portion of the bed to substantially allow the operator the freedom to swing her feet out through the foot corners to get out of bed. The bed, now lacking the hospital corner tautness, relieves pressure of the bed cover(s) upon the feet of the operator while still holding the bed cover(s) in place upon the bed during usage. The operator with the bed covers so anchored and centered upon the bed, can make the bed faster, with less effort/greater ease, in that operator only needs to bring one side of the bed covers into place and then move over to the other side to bring those portions of bed covers into place.

Upon substantial completion of this step, the method 200 could proceed back to step 204 for the application of other versions of the bed covers (e.g., blankets, quilts and the like.)

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally shown and described the invention could be a bed cover or cloth that has a generally rectangular base sheet with a tab sheet extending form the bottom base edge to generally form a T-shape. The tab sheet at a non-attached end that is the furthest away from the base sheet could have an open-ended pocket. An operator could place at least a portion of the operator's hand to insert the pocket underneath the mattress to generally secure the bed cover to the mattress. The tape having smaller size than the base sheet would not connect to the corners of the base sheet. This invention allows the operator to inset the tab sheet without having to grasp the bed cover or bed cover edge (the operator could place at least a portion of one hand into the open-ended pocket to guide at least the open-ended pocket towards and underneath the mattress [e.g., be inserted between a mattress and mattress support]. The invention secures the bed cover to the mattress in a manner that could allow: easy swinging of the operator's feet out from the bed, relieving bed cover tautness or tension upon the operator's feet, and easing the making of the bed (e.g., centering of the bed cover by the tab sheet.)

What is claimed is:

1. A bed cover and mattress combination comprising:

(A) the bed cover comprising a tab sheet connected to a base sheet, the base sheet is denoted by a top base edge, a bottom base edge, a first side base edge and a second side base edge, the top base edge being located opposite of the first base end, the second side base edge being located opposite of the first side base edge, wherein the top base edge and bottom base edge are connected together by the first side base edge and the second side base edge;

(B) the tab sheet has one end that forms a pocket tab portion and another end that forms a top tab portion, the top tab portion attaches to the base sheet via the bottom base edge while the pocket tab portion further forms an open-ended pocket having an aperture, the aperture opening out upon the top tab portion, the open-ended pocket being sufficiently constructed to accommodate at least a portion of a first hand of an operator passing through the aperture; and (C) a mattress having a top and a bottom connected together by a head end, a first mattress side, a second mattress side and a foot end forming a mattress width that is greater than a width of the tab sheet; wherein the base sheet lies over the top of the mattress, the open-ended pocket being placed underneath the mattress against the bottom to allow the bed cover and mattress combination to form a foot corner that allows easy passage of the operator's foot through the foot corner, a portion of the tab sheet is folded against a foot end of the mattress to align the aperture with an edge of the foot end.

2. The bed cover of claim 1 wherein the open-ended pocket is further constructed to additionally accommodate at least a portion of a second hand of the operator.

3. The bed cover of claim 2 wherein the open-ended pocket is bifurcated into open-ended sections.

4. The bed cover of claim 1 wherein the tab sheet and the base sheet together form a T-shape.

5. The bed cover of claim 4 wherein the tab sheet does not attach to an entire length of the bottom base edge.

6. The bed cover of claim 1 wherein the bed cover is unitary.

7. A bed cover and mattress combination comprising:

(A) the bed cover comprising a base sheet and a tab sheet that connect together to form a T-shape, wherein one end of the tab sheet further forms an open-ended pocket having an aperture that can allow passage of at least a portion of a first hand of the operator into the open-ended pocket; wherein the aperture further opens out onto the remaining tab sheet in a manner that allows the operator to move a combination of the at least portion of the first hand within an interior of the open-ended pocket to a position underneath a mattress to which the bed covering is being applied, the open-ended pocket being sufficiently constructed to accommodate at least a portion of a first hand of an operator passing through the aperture; and (B) a mattress having a top and a bottom connected together by a head end, a foot end, a first mattress side and a second mattress side forming a mattress width that is greater than a width of the tab sheet; wherein the base sheet lies over the top of the mattress, the open-ended pocket lies underneath the mattress against the bottom to allow the bed cover and mattress combination to form a foot corner that allows easy passage of the operator's foot through the foot corner, a portion of the tab sheet is folded against a foot end of the mattress to align the aperture with an edge of the foot end.

8. The bed cover of claim 7 wherein the open-ended pocket is bifurcated to further accommodated at least a portion of a second hand of the operator.

9. The bed cover of claim 7 wherein the base sheet and tab sheet are both rectangular.

10. The bed cover of claim 7 wherein the tab sheet does not meet a first edge base side or a second edge base side of the base sheet.

11. A method of applying a bed cover to a mattress comprising the following steps, but not necessarily in the order shown:

(A) providing a bed cover comprising a tab sheet connected to a base sheet, the base sheet is denoted by a top base edge, a bottom base edge, a first side base edge and a second side base edge, the top base edge being located opposite of the first base end, the second side base edge being located opposite of the first side base edge, wherein the top base edge and bottom base edge are connected together by the first side base edge and the second side base edge; the tab sheet has one end that forms a pocket tab portion and another end that forms a top tab portion, the top tab portion attaches to the base sheet via the bottom base edge while the pocket tab portion further forms an open-ended pocket having an aperture, the aperture opening out upon the top tab portion, the open-ended pocket being sufficiently constructed to accommodate at least a portion of a first hand of an operator passing through the aperture;

(B) providing a mattress having a top and a bottom connected together by a head end, a first mattress side, a second mattress side and a foot end forming a mattress width that is greater than a width of the tab sheet;

(C) inserting the at least a portion of first hand of an operator into the open-ended pocket to form a combination of the open-ended pocket and the at least a portion of first hand of an operator; and (D) directing the combination towards the bottom to locate at least a portion of the open-ended pocket under the bottom to allow the bed cover and mattress to form a foot corner that allows easy passage of the operator's foot through the foot corner, a portion of the tab sheet is further folded against a foot end of the mattress to align the aperture with an edge of the foot end.

12. The method of claim 11 wherein the directing the combination further comprises a step of inserting the combination between the mattress and a box spring.

13. The method of claim 11 wherein the inserting at least a portion of first hand of an operator into the open-ended pocket further comprises a step of inserting at least a portion of a second hand of the operator into the open-ended pocket.

14. The method of claim 13 wherein the open-ended pocket being bifurcated to allow the step of inserting at least a portion of a second hand of the operator into the open-ended pocket to further comprise a step of accommodating the at least portion of a second hand of operator within an open-end section.

15. The method of claim 11 wherein inserting the at least a portion of first hand of an operator into the open-ended pocket further comprises the step of placing the at least a portion of a first hand of an operator an open-handed position.

16. The method of claim 15 wherein the step of forming the operator's hand into an open hand position further comprises a step of spreading fingers apart from one another.

17. The method of claim 11 further comprises a step of removing the at least portion of the hand from the open-ended pocket while leaving the open-ended pocket underneath the mattress.

18. The method of claim 11 further comprises a step of removing the at least portion of the hand from the open-ended pocket while leaving the open-ended pocket between the mattress and a box spring.

* * * * *